United States Patent [19]

Shay et al.

[11] 4,020,979

[45] May 3, 1977

[54] SQUEEZE-BOTTLE-TYPE SPRAY DISPENSER

[75] Inventors: Joseph John Shay, Manchester; Donald Russell Falkowski, Derry, both of N.H.

[73] Assignee: Summit Packaging Systems, Inc., Londonderry, N.H.

[22] Filed: Oct. 15, 1975

[21] Appl. No.: 622,537

[52] U.S. Cl. ..... 222/211; 239/492

[51] Int. Cl.[2] ..... B05B 11/04

[58] Field of Search ..... 239/327, 405, 491, 492, 239/493–497; 222/4, 211, 206–209, 193, 215

[56] References Cited

UNITED STATES PATENTS

| | | | |
|---|---|---|---|
| 2,378,348 | 6/1945 | Wilmes et al. | 239/491 |
| 3,140,052 | 7/1964 | McCuiston | 222/215 X |
| 3,152,734 | 10/1964 | Berry | 222/211 |
| 3,381,860 | 5/1968 | Armour | 222/211 |
| 3,471,092 | 10/1969 | Hickey | 239/337 X |
| 3,474,936 | 10/1969 | McDonnell | 222/211 |
| 3,586,243 | 6/1971 | Jones | 239/492 |
| 3,785,571 | 1/1974 | Hoening | 239/337 X |

*Primary Examiner*—Stanley H. Tollberg
*Assistant Examiner*—Norman L. Stack, Jr.
*Attorney, Agent, or Firm*—Dallett Hoopes

[57] ABSTRACT

Closure for squeeze bottle is provided with swirl chamber into which liquid and air from inside the bottle are introduced. Either the liquid or the air, or both, are introduced to chamber tangentially, and air and liquid are worked therein under conditions of high shear. Fine, well-atomized mist discharges from central orifice from chamber. Orifice may be aimed axially or angularly to axis of container.

13 Claims, 18 Drawing Figures

SQUEEZE-BOTTLE-TYPE SPRAY DISPENSER

BACKGROUND OF THE INVENTION

1. Field of the Invention

This invention relates to squeeze-bottle-type spray dispensers. More specifically, this invention relates to a squeeze bottle spray dispenser having discharge means adapted to generate an unusually highly effective spray atomization.

2. Description of the Prior Art

In the prior art, there are a number of showings of spray nozzles for squeeze-bottle-type dispensers. An example is the U.S. Pat. No. 3,140,052 granted July 7, 1964 to McCuiston. These prior devices provide a container having flexible walls for developing air pressure sufficient to create some atomization of the liquid as it emerges from the dispenser. More specifically, when the bottle is squeezed, the liquid is forced up a dip tube to a discharge nozzle where it blends with discharging air also forced out in the squeezing of the bottle. Liquid emerges from the discharge orifice in the nozzle mixed to some degree with air so that there is a certain amount of atomization.

In the prior art, however, the spray nozzles mounted on squeeze bottles have not provided adequate atomization but have merely blended air and liquid under conditions of low shear so that in effect the liquid has emerged in the form of large poorly broken up particles rather than as a finely divided mist, as would be desirable when working with hair sprays, deodorants, and other popular liquid products.

In the aerosol art, it has been well known to dispense liquid through an aerosol actuator button having a mechanical break-up feature. In many cases, the break-up button has taken the form of a swirl chamber wherein the product is conducted tangentially into a tiny chamber in the actuator, the chamber having the discharge orifice at its center. As the liquid enters the swirl chamber, it acquires a tangential and axial moment of motion. Tangential as it swirls about the chamber, and axial as it moves toward the discharge orifice. The product emerging from the orifice, because of the motions set up in the chamber, forms into a cone-shaped spray of fine mist suitable for hair sprays and deodorants, for instance.

SUMMARY OF THE INVENTION

The present invention provides in a squeeze bottle a discharge nozzle comprising a swirl chamber wherein air from above the liquid in the squeeze bottle, or liquid product, or both, are introduced tangentially into a swirl chamber under conditions of high shear, and the liquid and air blend to produce an extremely effective atomization of the liquid. The liquid emerges from the discharge orifice in an extremely fine mist. In one embodiment, the nozzle takes the form of a plug disposed in the squeeze bottle discharge opening, the plug being formed with a post disposed about an aperture therein, and a cup-shaped insert fitting over the post, the post and insert between them providing a swirl chamber, the insert having a discharge opening centrally thereof.

BRIEF DESCRIPTION OF THE DRAWING

Other features and objects of the invention will be apparent from the following specification including the drawings, all of which disclose non-limiting embodiments of the invention including a preferred embodiment. In the drawings.

DESCRIPTION OF THE PREFERRED EMBODIMENT

Figure 1:
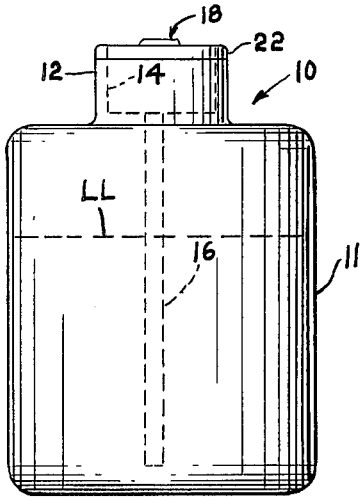
FIG. 1 is a side elevation of a squeeze bottle embodying the invention.

Referring more specifically to the drawings, a squeeze bottle embodying the invention is shown in FIG. 1 and generally designated 10. It comprises a container typically of blow-molded polyethylene having body 11 and necked in at the opening to provide a mount 12 having an opening therethrough into the body of the container. The invention involves a plug 14 adapted to be press-fitted snugly in sealing relation into the mouth 12 of the container. The plug is provided with a dip tube 16 and an insert 18 having a discharge opening therein.

Figure 2:
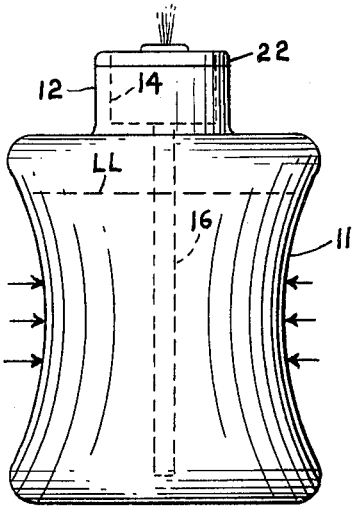
FIG. 2 is a side view of the squeeze bottle of FIG. 1 showing the sidewalls being compressed to effect a spray.

FIG. 2 demonstrates that when the opposite sides of the container body 11 are squeezed in, the liquid level LL is driven upward. This reduces the amount of space in the container above the liquid level and therefore compresses the air thereabove increasing the pressure on the surface of the liquid level thereby forcing liquid up the dip tube 16 into the plug 14 for dispensing therethrough. Additionally, air is driven up into the plug 14 for mixing with the liquid as will be explained.

Figure 4:
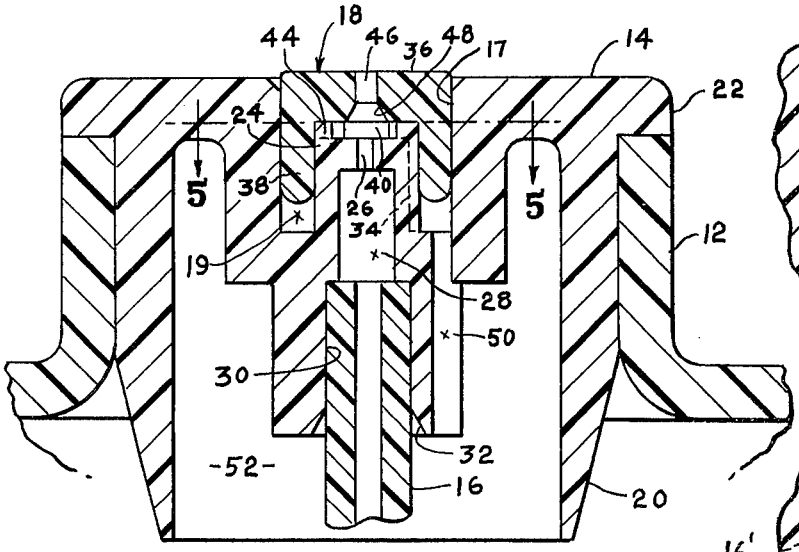
FIG. 4 is a greatly enlarged fragmentary view in section of the discharge nozzle shown in FIG. 1.

A preferred embodiment of the invention is shown in FIG. 4 wherein the plug 14 is of molded plastic and fits snugly within the mouth 12. The fit may be frictional or the parts may be welded in position, as by ultrasonics. The plug 14 is cylindrical, as shown, and is tapered at its lower end at 20. At the upper end, a stop flange 22 is provided to engage the upper end of the mouth 12.

Centrally of the plug 14 there is a recess 17 from the bottom of which extends upward a post 24. The post has a central opening 26 which communicates by a channel 28 to an enlarged socket 30 receiving the upper end of the dip tube 16. A chamfered leadin 32 for the dip tube may be provided. Preferably, the dip tube is a conventional extruded plastic tube as is provided with aerosol valves. The side wall of the post is provided with one or more downward channels 34.

As stated, in the embodiment shown, the insert 18 is cupshaped and may be of molded plastic such as polyethylene. Alternatively, as will be described, the insert may be a disc, even a concave one, or part of the plug 14. The version shown comprises a top wall 36 and cylindrical side walls 38.

The top of the post is formed with a central swirl chamber 40 having a plurality of tangential entranceways 42. The inlet passages 34 communicate with the tangential entranceways 42. The swirl chamber 40 and the passageways 42 are defined by four spaced V-shaped protuberances 44 against the top of which the top wall 36 of the insert abuts and it should be understood that while a single tangential entranceway may suffice to create a swirl in the chamber, a pair or more of such entranceways are desirable.

The insert is provided with a central opening 46 and a tapered transition 48 extends from the swirl chamber 40 to the orifice 46. The insert 18 snugly engages the side walls of the recess 17. It may be staked or welded in, or may be a friction fit. The lower annular end 19 of the recess 17 surrounding the post 24 is connected by a molded passageway 50 to the lower end of the plug 14 so that air from above the liquid in the container can readily communicate up to the bottom of the recess. As shown, for reasons well-known in the art, the plug is not solid but is formed with an annular upward cavity 52 primarily to reduce the thickness of plastic in the parts.

With the structure thus described, snugly fitting in the neck or mouth of a squeeze bottle after filling of the bottle to the liquid level LL, effective mist-spray may be achieved. As shown in FIG. 2, squeezing of the side walls of the container together drives liquid up dip tube 16 and raises the liquid level LL. The raising of the liquid level causes increased pressure above the liquid which further drives liquid up the tube 16. It also causes air to rush up the passage 50 (FIG. 4) into the annular space 19 at the bottom of the recess 17 and thence up the passages 34 to enter tangentially through passageways 42 into swirl chamber 40. Contemporaneous swirling of the air in the chamber 40 and inflow of liquid moving up through passages 28, 26 into the chamber 40 causes the violent intermixture of liquid and swirling air under conditions of extremely high shear. As this liquid airmixture, driven by the increased pressure in the bottle moves inward through tapered transition 48 to the discharge passage 46 its angular velocity increases due to the reduction in diameter of the effective confines of the swirl so that even greater shear is produced and the emerging liquid forms a vortex of fine spraymist.

Herein and in the claims the word "tangential" is used to include a movement into the chamber from a point at the periphery of the chamber and aiming to one side of the axis rather than directly at the axis of the chamber.

The spray-mist thus produced is suitable for application of hair spray and liquid deodorants, for instance. A remarkable feature flowing from the invention is that a relatively little amount of squeezing of the body 11 causes a considerable duration of high-quality mist-spray. This is because of the effectiveness of the atomization system, all due to the presence of the swirl chamber 40 and the tangential entranceways for air.

The passages 34 in the embodiment so far described may be replaced by an annular space between insert and post, if the post is reduced in diameter, for instance.

MODIFICATION

Figure 6:
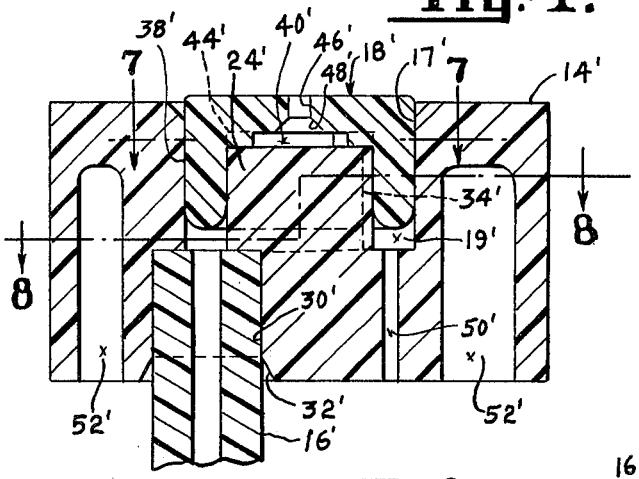
FIG. 6 is a sectional view of an alternate form of the plug shown in FIG. 4.

A modified form of plug embodying the invention is shown in FIG. 6. The plug in this embodiment is designated 14' and it offers the recess 17' with a centrally disposed post 24'. This leaves an annular well into which a cup-shaped insert 18' may be press-fitted in sealing engagement with the sides thereof. As shown, the side walls 38 of the insert 18' do not extend to the bottom of the well but leave thereunder an annular chamber 19'. Connected with one side of the chamber is a socket 30' which receives the dip tube 16' in sealing secure engagement. The chamfer 32' may be provided to lead the dip tube 16' into the socket. An air passage 50' is provided at the other side of the plug extending downward from the annular chamber 19'. Cavity 52' assures that the molded dimensions of the plug will not be too thick for reasons well-known in the art.

As shown (FIG. 7), the underside of the end wall of the insert may be formed with downward concentric shoulders 44'. These shoulders are spaced to form entranceways 42' at opposite sides of a swirl chamber 40'. The side of the post 24' may carry grooves as at 34' to provide longitudinal channels to the top of the post. In assembly, the insert 18' is shoved down over the post 24' so that its side walls snugly engage the side walls of the recess 17'. The insert 18' is formed with a transition 48' and a discharge orifice 74' comparable to those of the earlier embodiment.

Figure 7:
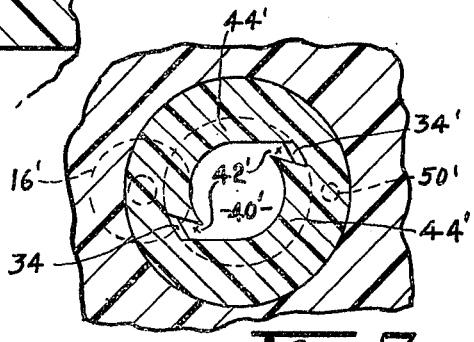
FIG. 7 is a fragmentary sectional view taken on the line 7—7 of FIG. 6.
Figure 8:
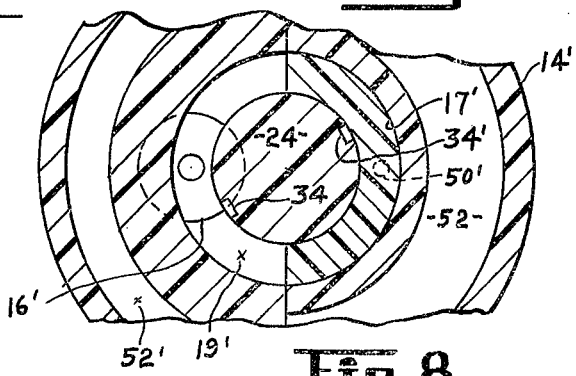
FIG. 8 is a fragmentary sectional view taken on the offset line 8—8 of FIG. 6.

With the FIGS. 6 through 8 embodiment, the operation is characterized by the increased pressure above the liquid level LL driving liquid and air up the dip tube 16' and passage 50' respectively into the annular passage 19'. In this annular passage, the liquid and air intermix and move therefrom up the passages 34' into the tangential inlets 42' of the swirl chamber 40'. The swirling mixture of air and liquid narrows in size as it moves through transition 48 and out passage 46' under conditions of high shear. Here again, the dispensing is characterized by a highly efficient mist requiring only a modest exertion in the way of a squeezing pressure on the container body 11.

FURTHER EMBODIMENTS

Figure 3:
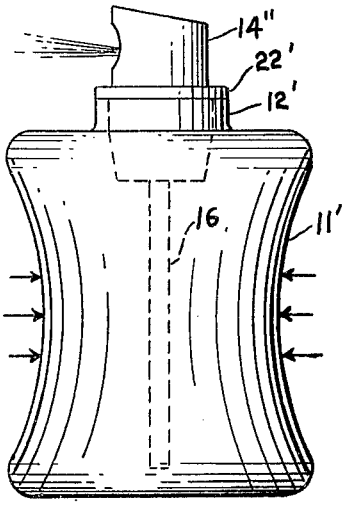
FIG. 3 is a comparable to FIG. 2 except that it shows a discharge nozzle having the discharge aimed at right angles as compared to the discharge in FIG. 2.

Because it is desired in some instances for convenience of the user, discharge of spray may be in a direction angular to the axis of the container, for instance perpendicular thereto. In the FIGS. 9, 10 embodiment, there is shown a section of the FIG. 3 dispenser. This dispenser comprises the collapsible or resilient side wall 11' having a mouth 12' into which a plug 14'' fits. As is well shown in FIG. 9, the plug 14'' comprises a side wall fitting snugly in the opening 12'. The side wall may have the tapered lower end as at 20'. The plug body is formed with a stop flange 22′ which sits on the top of the mouth 12′ of the container.

Figure 9:
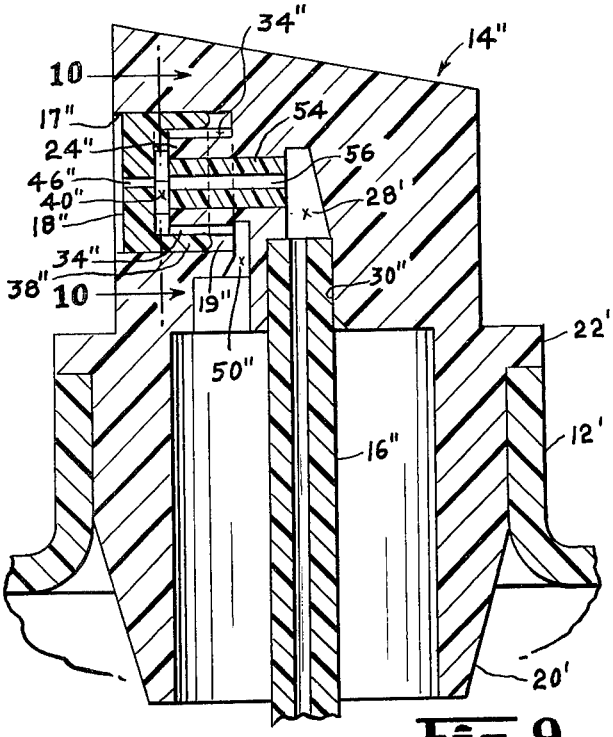
FIG. 9 is a greatly enlarged fragmentary sectional view of the nozzle shown in FIG. 3.
Figure 10:
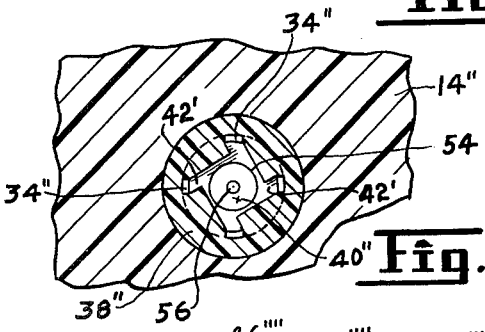
FIG. 10 is a sectional view taken on the line 10—10 of FIG. 9.
Figure 12:
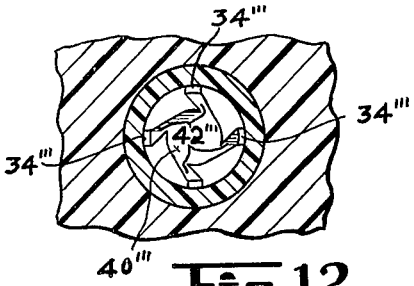
FIG. 12 is a sectional view taken on the line 12—12 of FIG. 11.

As shown, the body of the plug 14″ extends upward and on its leftward face, as shown in FIG. 9, is formed with a recess 17″ from the floor of which extends a post 24″. The annular well thereby defined, receives the side wall of a cup-shaped insert 18″ in snug engagement on both its inside and outside. Grooves 34″ extend along the post from the bottom of the annular chamber 19″.

Figure 5:
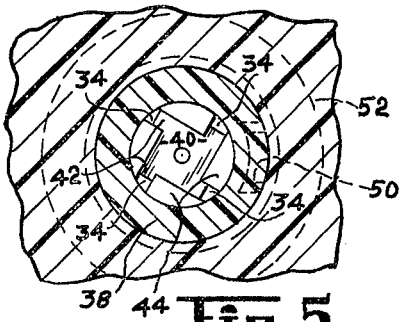
FIG. 5 is a sectional view taken on the line 5—5 of FIG. 4.

The insert 18 is formed on the inside of its end wall 35″ with a swirl chamber defined by a stamped cross comparable to that shown in FIG. 5. The cross defines a central swirl chamber 40″ with tangential entranceways 42″.

Extending upward from the underside of the top portion of the plug body 14″ is discharge channel 28′ which is cylindrical in its lower portion 30″ and receives the dip tube 16″. The end of the post 24″ is formed with a bore into the passage 28″, the bore preferably receiving a tubular restriction 54 having a central passage 56 communicating to the center of the swirl chamber 40″ from the discharge passage 28′. Alternatively, the tubular restriction 54 can be dispensed with and the passage 56 molded directly in the plug. An air channel 50″ is formed alongside the passage 30″ in the plug body and communicates up to the annular chamber 19″.

Increase in pressure due to the rise of the liquid level LL upon squeezing of the bottle drives liquid up dip tube 16″ through passages 28′ and 56 into the center of the swirl chamber 40″. Air is also driven up channel 50″ into the annular chamber 19″ along passages 34″ to the tangential inlets 42″ and into the swirl chamber 40″. Swirl thus created moves out the discharge orifice 46″ in the form of a fine spray-mist at right angles to the axis of the container.

Figure 11:
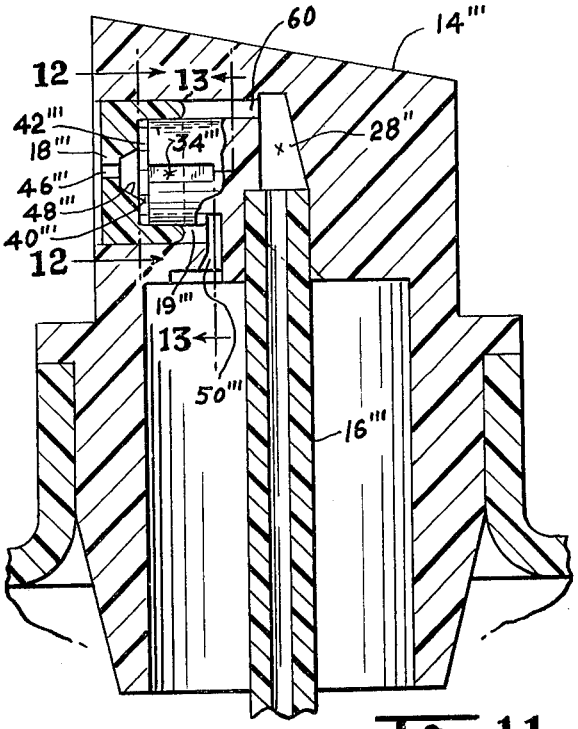
FIG. 11 is a view comparable to FIG. 9 but showing a modified form of nozzle of FIG. 9.
Figure 13:
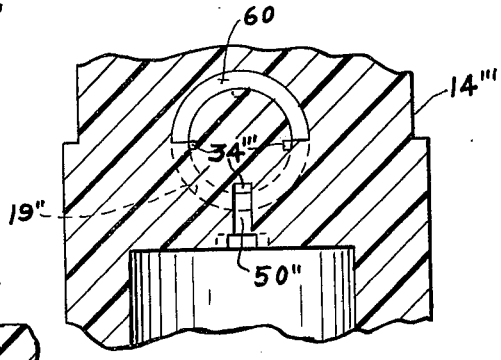
FIG. 13 is a sectional view taken on the line 13—13 of FIG. 11.

Another so-called right-angle embodiment is shown in FIGS. 11 and 13. This modification is substantially similar to the FIGS. 9, 10 embodiment except that in the plug 14″, the liquid passage 28″ from the upper end of the dip tube 16″ communicates directly through passage 60 with the annular chamber 19‴. Similarly, the air passage 50‴ communicates with the chamber 19‴. The resulting mixture of liquid and air travels along passages 34‴ into the tangential passages 42‴ defined by projections on the post in this embodiment and into the central swirl chamber 40‴. Subsequently, the mixture, well atomized, then moves out the transition 48‴ into the discharge orifice 46‴ from which it emerges as a fine mist. Here again, the discharge is perpendicular to the axis of the container.

Figure 14:
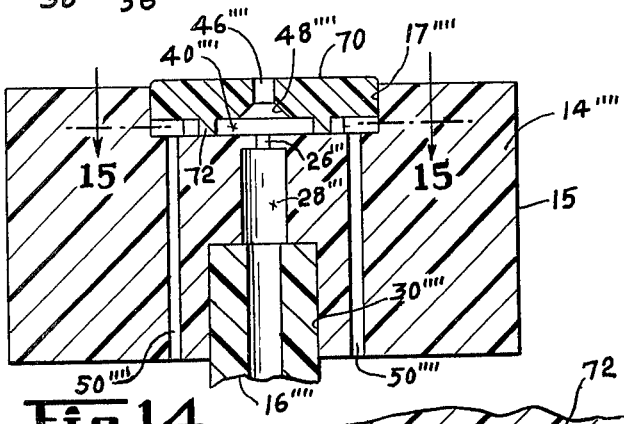
FIG. 14 is a sectional view of a modified form of plug embodying the invention.
Figure 15:
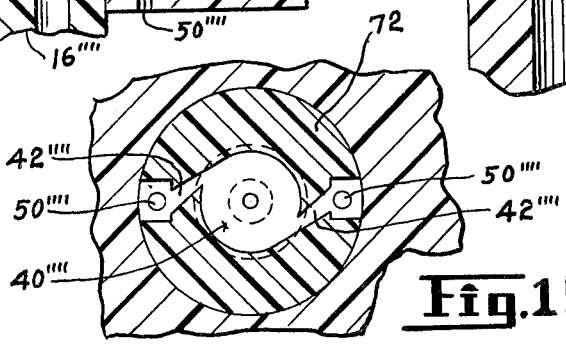
FIG. 15 is a sectional view taken on the line 15—15 of FIG. 14.

In the FIGS. 14, 15 embodiment, the plug 14‴ is formed with a shallow central recess 17⁗. Side wall 15 of the plug 14⁗ is adapted to engage in the mouth 12 of a squeeze bottle as with other embodiments. The embodiment 14⁗ presents passages 50⁗ from the bottom of the plug up to the floor of the recess 17⁗ as shown, terminating in preferably diagonally opposite points in the recess. A central opening 30⁗ in the bottom of the plug receives the dip tube 16⁗ and from above that opening, a passage 28‴ communicates through restriction 26‴to a central portion of the recess 17⁗. A disc insert 70 is provided and has formed on its underside arcuate walls 72 (FIG. 15) which define a central swirl chamber 40⁗. Tangential lead-ins 42⁗ are formed intermediate walls 72 and the disc 70 is oriented so that the outer ends of the tangential entranceways 42⁗ communicate with the air passages 50⁗. As shown, the insert 70 is formed with a transition 48⁗ and a discharge orifice 46⁗ connecting therewith. As the bottle in the FIGS. 14, 15 is squeezed pressure drives air up passages 50⁗ and into tangential passageways for the swirl chamber 40⁗. Liquid is similarly driven up dip tube 16⁗, through passages 28‴ and 26‴ into the center of the swirl chamber. From the chamber, the liquid-air mixture moves out transition 48⁗ and passage 46⁗ into the air as a fine mist.

FURTHER MODIFICATION

Figure 16:
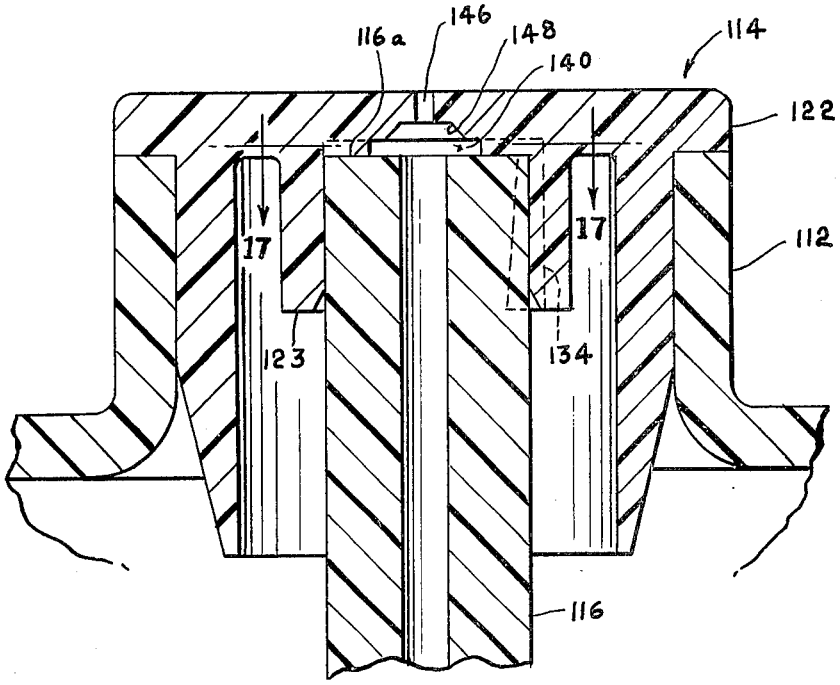
FIG. 16 is a sectional view of a further modification.
Figure 17:
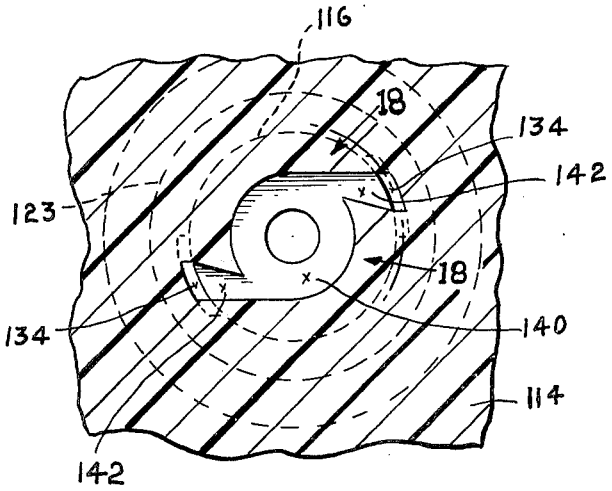
FIG. 17 is a fragmentary sectional view taken on the line 17—17 of FIG. 16.
Figure 18:
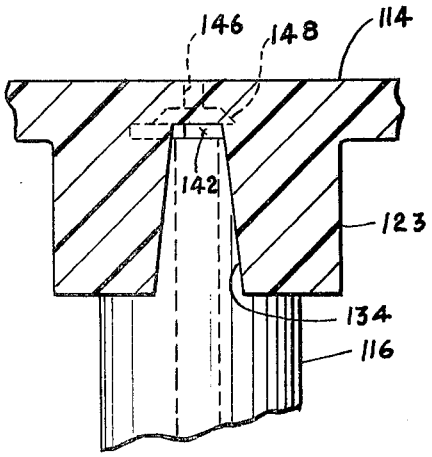
FIG. 18 is a fragmentary sectional view taken on the line 18—18 of FIG. 17.

FIGS. 16 through 18 show an additional embodiment of this invention. In this embodiment, the plug 114 first snugly in the mouth 112 of a plastic squeeze bottle. As shown, the plug may have a tapered lead-in at its lower end and a stop flange 122 to abut the upper end of the bottle. A downward annular skirt 123 is disposed centrally on the underside of the top wall of the plug, and this skirt receives the upper end of the bottle dip tube 116. The upper end face 116*a* of the dip tube is cut off flat at right angles to the length of the tube and abuts squarely against the underside of the wall as shown.

As is well illustrated in the sectional view FIG. 17, the inside surface of the skirt 123 is formed with longitudinal grooves 134. These grooves, as shown in FIG. 18, may be tapered for ease of molding.

The undersurface of the upper wall of the plug 114 inside the skirt 123 is formed with a central cylindrical recess 140 comprising a swirl chamber. Tangential entranceways 142 are also formed in the said undersurfaces and direct the grooves 134 tangentially to the recess 140 as in the other embodiments. A discharge orifice 146 is provided in the top wall of the plug 114 and a tapered lead-in section 148 serves as a transition in which the swirling liquid-air mixture in the swirl chamber narrows in diameter as it moves toward the orifice.

The operation of the FIGS. 16–18 embodiment is comparable to that of the earlier described embodiments. As stated, the recess 140 as closed off by the flat upper end of the dip tube 116 forms a swirl chamber. Therefore, when the associated bottle is squeezed, air within it is pressurized and drives up grooves 134 which comprise passageways closed along one side by the outside of the snug-fitting tube. From the top of these passageways, the air goes into the tangential entranceways 142 which deliver the air in directions offset from the center of the chamber to the recess 140 comprising the swirl chamber. Both the tangential entranceways and the chamber are closed off on their underside by the flat top of the dip tube. The swirling air in the chamber encounters the liquid that is driven up the dip tube 116 by the pressure in the squeezed bottle. This encounter is violent. The swirling air generates high shear and the liquid on contact with the air is broken up and a portion of it swirls about the chamber. This swirling fluid moves into the transition 148 where its particles increase in annular velocity due to their tendency to maintain their linear speed as they are compressed into an increasingly smaller passage. Finally, the highly atomized fluid emerges from the orifice 146 as a vortex of fine mist forming for an instant a vortex cone on the outside of the orifice. The mist thus produced is effective for dispensing of deodorants, hair sprays and other products.

The word "fluid" in the appended claims is understood to include liquid or gas. Many additional embodiments are envisioned. For instance, while the arrangement shown in FIG. 4 is a preferred embodiment, many of the advantages of the invention can still be enjoyed by a structure similar to that shown in FIG. 4 in which the passage 28, 30 connected to the dip tube is left open for air passage and the passage 50 is shaped to receive the dip tube 16 in sealing fit so that on squeezing the bottle the liquid moves into the swirl chamber circumferentially through passage 19, grooves 34 and entranceways 42. Air from the inside of the bottle moves up through passage 26 axially into the chamber and the ensuing working of the air and liquid in the swirl chamber results in a high degree of atomization as the mixture emerges from the discharge orifice.

It should thus be clear that many embodiments not disclosed are possible, and the invention is of extremely broad scope capable of being defined by the appended claim language or equivalents thereof:

We claim:

1. For a squeeze bottle a closure having a discharge orifice for discharging a fine spray mist, the closure having means to sealingly engage the bottle mouth, the closure having a swirl chamber formed therein coaxial and just behind the orifice and having its center communicating with the orifice, a dip tube adapted to have its lower end extend into the bottle immersed in liquid, its upper end securely engaging the closure, the upper end of the dip tube being operatively connected into the swirl chamber at a first locus, and passage means in the closure extending from the inside of the bottle above the liquid level to conduct air into the swirl chamber at a second locus, at least one of said loci being located at the periphery of the chamber and the entry of the associated fluid thereto being effected channel means terminating at the said locus and directing the associated fluid circumferentially into the chamber in a tangential direction in an unobstructed path, whereby a fluid swirl is created to discharge highly atomized liquid form the orifice.

2. A closure as claimed in claim 1 including passage means in the closure between the upper end of the dip tube and the first locus is on the axis of the chamber.

3. A closure as claimed in claim 1 wherein the upper end of the dip tube comprises the inner wall of the chamber and the opening in the upper end of the dip tube delivers liquid directly to the first locus which is on the axis of the chamber.

4. A closure as claimed in claim 1 wherein the closure has formed in its outer surface an annular well defining a central post and a cup-shaped insert fits snugly into the well over the post, the insert and post between them defining the swirl chamber.

5. A closure as claimed in claim 4 wherein the side walls of the swirl chamber are formed on the post by outward projections thereon against the end of which the insert abuts.

6. A closure as claimd in claim 4 wherein the side walls of the swirl chamber are formed in the insert as shoulders on the underside of the end wall thereof, the shoulders butting against the outer end of the post.

7. A closure as claimed in claim 1 wherein the orifice is on a surface of the plug disposed non-perpendicularly to the axis of the container.

8. A closure as claimed in claim 4 wherein air is introduced to the swirl chamber at said one locus by passing through the closure by way of an annular channel at the bottom of the well under the insert and from thence through passage means between the post and the insert to the said locus.

9. A closure as claimed in claim 8 wherein the dip tube also communicates with said annular channel.

10. A closure as claimed in claim 1 wherein the outer surface of the closure is formed with a recess and an insert is disposed in the recess, the bottom of the recess and the undersurface of the insert forming between them the swirl chamber, the orifice being disposed in the insert.

11. A squeeze bottle having an opening closed by a closure formed with an annular well defining therein an upstanding post, an inverted cup-shaped insert having a central discharge orifice and being snugly fitted into the well, the insert and post between them defining a swirl chamber having tangential inlet, air passage means comprising a plurality of channels also defined between the insert and post leading from the rim of the cup shaped insert to circumferential positions in the swirl chambers and adopted to direct air tangentially into the chamber in an unobstructed path, the air passage means also comprising a passageway from the underside of the closure to the channels, a dip tube extending down into the container, means holding the upper end of the dip tube in the plug, liquid passage means extending from the upper end of the dip tube to the center of the swirl chamber, the discharge orifice being no greater in diameter than the swirl chamber.

12. A squeeze bottle as claimed in claim 11 wherein the orifice is on a surface disposed non-perpendicularly to the axis of the bottle opening.

13. For a squeeze bottle having an opening, a spraygenerating assembly comprising:

a. a closure adapted to close the opening, the closure having air passage means extending outward from the inside of the closure;

b. dip tube means adapted to extend upward from a position low in the bottle and having its upper end supported in the closure;

c. a closing element having a central discharge orifice and being secured over an outwardly-facing portion of the plug, the outwardly-facing portion and inner surface of the closing element defining a closed swirl chamber at least as large as said discharge orifice and being generally concentric with and connected to the orifice, the swirl chamber having a plurality of tangential inlet channels for conducting fluid into the chamber in unobstructed fashion to thereby create a swirl, air passage means from the underside of the plug to the channels, said upper end of the dip tube being connected to the swirl chamber at its central point.

* * * * *